United States Patent [19]

Freedman

[11] Patent Number: 4,890,215

[45] Date of Patent: Dec. 26, 1989

[54] ELECTRICAL APPARATUS WITH REVERSE AUDIBLE ALARM

[75] Inventor: Herb Freedman, Willowdale, Canada

[73] Assignee: Selectrons Ltd., New York, N.Y.

[21] Appl. No.: 214,151

[22] Filed: Jun. 30, 1988

[51] Int. Cl.[4] ..... H02M 7/02

[52] U.S. Cl. ..... 363/63; 340/657; 340/680

[58] Field of Search ..... 363/63; 307/262; 361/82, 83, 84; 340/70, 649, 657, 672, 680, 686, 463, 438

[56] References Cited

U.S. PATENT DOCUMENTS

| | | | |
|---|---|---|---|
| 3,569,927 | 3/1971 | Guyton | 340/70 X |
| 3,629,819 | 12/1971 | Peterson | 340/70 |
| 3,827,024 | 7/1974 | Anderson et al. | 340/672 X |
| 3,905,016 | 9/1975 | Peterson | 340/70 |
| 4,413,248 | 11/1983 | Staerzl | 340/52 F X |
| 4,602,203 | 7/1986 | Bragdon | 250/222.1 X |
| 4,763,017 | 8/1988 | Campbell et al. | 363/63 X |

*Primary Examiner*—Patrick R. Salce
*Assistant Examiner*—Kristine Peckman
*Attorney, Agent, or Firm*—John H. Crozier

[57] ABSTRACT

In a preferred embodiment, a reversible DC power supply having an audible alarm, especially for use with electrochemical metallizing equipment. The audible alarm is electrically connected directly to the controls of the power supply so that when the power supply is placed in its "reverse" mode, the audible alarm will continuously sound, thus alerting the operator that the power supply is in that mode. In other embodiments, reversible electric tools, such as drills, may be provided with an audible alarm to indicate when they are in their reverse states.

8 Claims, 1 Drawing Sheet

ELECTRICAL APPARATUS WITH REVERSE AUDIBLE ALARM

BACKGROUND OF THE INVENTION

1. Field of the Invention

This invention relates to reversible electrical apparatus generally and, more particularly, to electrical apparatus which incorporate an audible alarm to alert the user that the electrical apparatus is in its reverse mode.

2. Background Art

While the present invention is described in some detail, for illustrative purposes, as being applied to a reversible DC power supply for electrochemical metallizing equipment to indicate when such power supply is in its reverse mode, it is within the intent of the present invention to encompass any application where it is desired to indicate, by audible means, when an electrical apparatus is in one of two modes. For example, the present invention may be incorporated into an reversible electric drill or similarly reversible electric tool, portable or stationary, to indicate when the drill is in reverse.

Electrochemical metallizing is a well known and useful technique for applying a surface deposit of any of a large number of metals or alloys to a base metal or alloy and comprises the bushing on of a plateable metal upon partial, selected areas of a metal or metallized part, usually an industrial component such as a tool, die, shaft, bearing, printing roll or similar machine part. Applications for electrochemical metallizing are found in a wide variety of industries, including aircraft, printing, materials handling, railroad, and printed circuits, for example. In many cases, the deposited and base metals are the same, especially when the component is one that is being repaired, although the metals may not necessarily be the same. The technique may also be used to place a solderable coating on metals that are not normally directly solderable. For example, a layer of nickel or copper may be placed by electrochemical metallizing on the surface of an aluminum component, after which that surface may be directly soldered using conventional soldering techniques. Equipment and materials for electrochemical metallizing processes are manufactured by Selectrons Ltd., Waterbury, Connecticut.

While electrochemical metallizing involves electrochemical deposition, it is not carried out in a conventional plating bath. Instead, the electrodeposit is swabbed or "painted" onto the surface to be coated. In appearance, electrochemical metallizing practice resembles arc welding more than electroplating. A cathodic cable from a special power supply is connected to the base metal. A second cable is connected anodically to the power supply and to any one of several working tools known as styluses comprising anodes of different sizes and shapes. The anodes are covered with an absorbent material, dipped into a plating solution (or the solution is flowed through or onto the anode), and the circuit completed by swabbing the wrapped anode over the area where metal build-up is desired. Electrochemical anodizing for etching or marking, for example, is accomplished in a similar fashion except that the current is reversed. The electrochemical metallizing equipment is very portable and obviates the need for sometimes large and heavy components to be moved to another location for repair, thus saving not only direct expense but also reducing downtime.

Normally in electrochemical metallizing there are three separate steps. In the first step, the base metal is cathodically connected to the power supply while the anodically connected stylus, which has been dipped in a cleaning solution, is used to electroclean the base metal to remove oils, dirt, etc. Then the current is reversed so that the stylus becomes the cathode and the base metal the anode, for scale and oxide removal and to activate the base metal. Following the latter step, the polarities are again reversed, returning them to the "forward" mode and metallizing proceeds as described above. A particular problem in the procedure is that the operator may neglect to effect the second reversal of polarities, thus leaving the base metal anodically connected to the power supply. The result of this is that metallizing cannot be accomplished and base metal starts to be lost, resulting in wasted time, at best, and in unsalvageable parts, at worst. While the power supplies used normally have lights to indicate in which mode the power supplies are set, the warning given by the lights is passive in that the operator must remember to check the lights before attempting to proceed with metallizing. Too frequently, the operator does not.

Accordingly, it is a principal object of the present invention to provide an audible alarm for reversible power supplies.

It is a further object of the invention to provide an audible alarm for reversible DC power supplies for electrochemical metallizing.

It is another object of the invention to provide such an alarm that is relatively inexpensive and easily incorporated into standard power supplies.

Other objects of the invention, as well as particular features and advantages thereof, will, in part, be obvious and will, in part, be apparent from the following description and the accompanying drawing figure.

SUMMARY OF THE INVENTION

The present invention accomplishes the above objects, among others, by providing an audible alarm for reversible DC power supplies, especially those for use with electrochemical metallizing equipment. The audible alarm is electrically connected directly to the controls of the power supply so that when the power supply is placed in its "reverse" mode, the audible alarm will continuously sound, thus alerting the operator that the power supply is in that mode.

DETAILED DESCRIPTION OF THE PREFERRED EMBODIMENT

Figure 1:
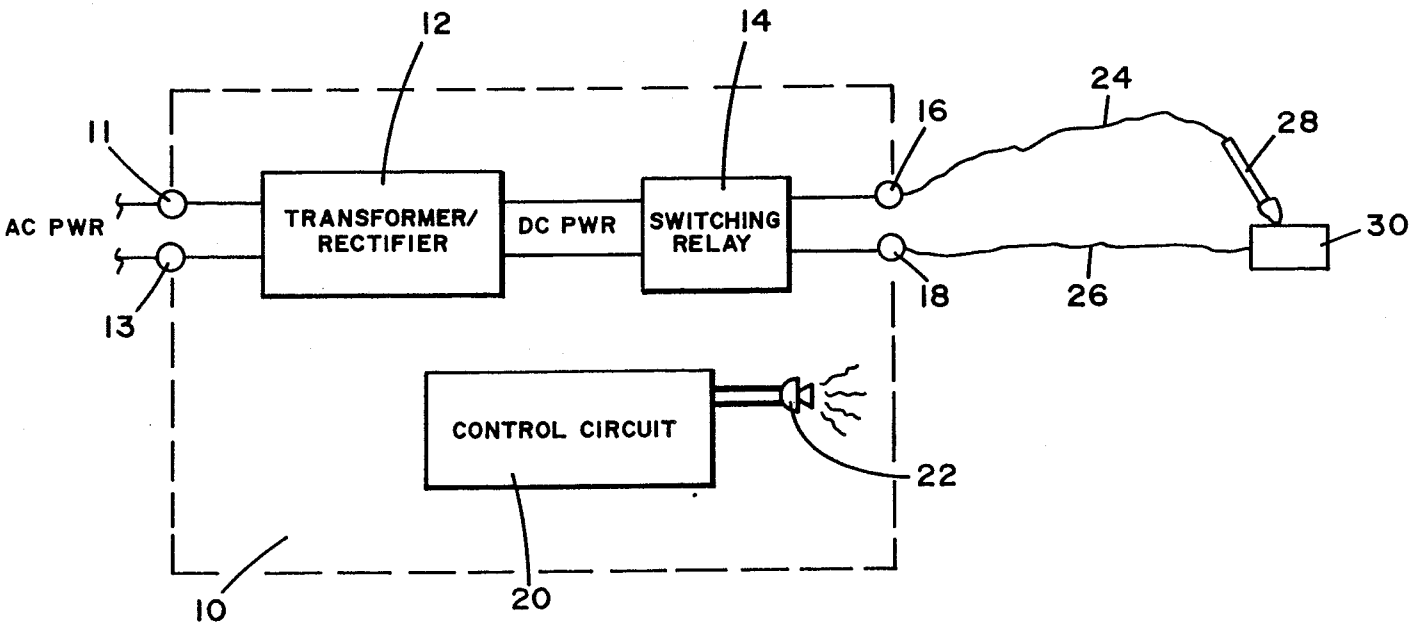
FIG. 1 is a partially block diagram showing a reversible DC power supply, constructed according to the present invention, connected to an electrochemical metallizing stylus and to a base metal to be metallized.

Referring now to FIG. 1, there is shown a DC power supply 10 which includes a transformer/rectifier 12 connected to a source of AC power (not shown) through input connections 11 and 13. Transformer/rectifier 12 receives AC power from input connections 11 and 13 and supplies DC power to a switching relay 14. Switching relay 14 provides DC output power having a selected polarity to output connections 16 and 18. A control circuit 20 connected to transformer/rectifier 12 and to switching relay 14 controls the level of the output voltage of power supply 10, provides indicated of the output voltage and current, and controls the polarity of the output. Connected to control circuit 20 is audible alarm 22 which is so connected as to provide an audible signal when power supply 10 is in its "reverse" mode.

Attached to output connections 16 and 18 are cables 24 and 26, with cable 24 being attached to an electrochemical metallizing stylus 28 and cable 26 being attached to base metal 30 to be metallized by the stylus. As shown for metallizing, power supply 10 would be in its forward mode so that stylus 28 would be the anode and base metal 30 the cathode of the metallizing circuit. Since power supply 10 is in its forward mode, it may be assumed that FIG. 1 shows the third of the three steps described above, that is the step of the actual deposition of metal on the base metal. The first step, that of cleaning base metal 30 would have taken place with the power supply also in its forward position, but with stylus 28 having first been dipped in a cleaning solution. Following the cleaning step, the polarity of power supply 10 would have been reversed for descaling and oxide removal. Following the descaling step, power supply 10 should have been changing to its forward mode; however, if it had not been, audible alarm 22 would sound, thus alerting the operator to change the setting immediately.

The circuitry of power supply 10 is conventional and known to those skilled in the art. Audible alarm 22 is preferably of the type whose output is a continual "beeping" sound and is preferably adjustable so that its output can be set to be of sufficient loudness to be easily heard over any background noise in the area of use. Such a "beeper" may be the "Bell Audioalarm", supplied by Floyd Bell Inc., Columbus, Ohio.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figure shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An electrical apparatus having forward and reverse states, to provide electrical power to a tool, comprising:

(a) input means to receive input electrical power;

(b) output means for electrical connection to said tool;

(c) switching means connected to said input means to selectively change between said forward and reverse states and connected to provide on said output means forward or reverse electrical energization; and (d) alarm means connected to said switching means to produce an audible sound when said electrical apparatus is in one of said forward and reverse states.

2. An apparatus, as defined in claim 1, wherein said alarm means produces said audible sound continually when said electrical apparatus is in said one of said forward and reverse states.

3. An apparatus, as defined in claim 1, wherein said alarm means comprises a beeper.

4. An apparatus, as defined in claim 1, wherein said apparatus comprises a DC power supply.

5. An apparatus, as defined in claim 4, wherein said tool is an electrochemical metallizing stylus.

6. An electrochemical metallizing apparatus having forward and reverse states, comprising:

(a) input means for connection to a source of AC power;

(b) output means connected to an electrochemical metallizing stylus and to a base metal to be metallized;

(c) transformer/rectifier means connected to said input means;

(d) switching relay means connected to receive DC power from said transformer/rectifier means and to provide said DC power to said output means;

(e) control means connected to said transformer means and to said switching relay means to cause said switching relay means to selectively switch between said forward and reverse states; and (f) alarm means connected to said control means to produce an audible sound when said DC power supply is in its reverse state.

7. A power supply, as defined in claim 6, wherein said alarm means produces said audible sound continually when said power supply is in said reverse state.

8. A power supply, as defined in claim 6, wherein said audible alarm means comprises a beeper.

* * * * *